US007357471B2

(12) United States Patent
Clark

(10) Patent No.: US 7,357,471 B2
(45) Date of Patent: Apr. 15, 2008

(54) METHOD AND APPARATUS FOR FLUID DISPENSING USING CURVILINEAR DRIVE WAVEFORMS

(75) Inventor: James E. Clark, Naperville, IL (US)

(73) Assignee: Perkinelmer Las, Inc., Waltham, MA (US)

( * ) Notice: Subject to any disclaimer, the term of this patent is extended or adjusted under 35 U.S.C. 154(b) by 0 days.

(21) Appl. No.: 10/974,655

(22) Filed: Oct. 27, 2004

(65) Prior Publication Data

US 2005/0088468 A1 Apr. 28, 2005

Related U.S. Application Data

(60) Provisional application No. 60/481,568, filed on Oct. 28, 2003.

(51) Int. Cl.
*B41J 29/38* (2006.01)

(52) U.S. Cl. ..... 347/9; 347/10

(58) Field of Classification Search ..... 347/11, 347/9, 10

See application file for complete search history.

(56) References Cited

U.S. PATENT DOCUMENTS 3,683,212 A 8/1972 Zoltan
4,562,445 A * 12/1985 Rich ..... 347/9
4,743,924 A * 5/1988 Scardovi ..... 347/10
5,124,716 A 6/1992 Roy et al.
5,736,994 A 4/1998 Takahashi
6,203,759 B1 3/2001 Pelc et al.
6,513,894 B1 2/2003 Chen et al.

OTHER PUBLICATIONS

Chen, et al., "A New Method for Significantly Reducing Drip Radius Without Reducing Nozzle Radius in Drop-on-Demand Drop Production", Physics of Fluid, vol. 14, No. 1, Jan. 2002.
Lee, Eric R., "Microdrop Generation", Stanford Linear Accelerator Center, Stanford University, ISBN 0-8493-1559-X—CRC Press LLC, 2003
Pond, Stephen F., Ph.D., "Inkjet Technology and Product Development Strategies" Torrey Pines Research, Torrey Pines Research, 2000, Carlsbad, California.

* cited by examiner

*Primary Examiner*—Julian D. Huffman
(74) *Attorney, Agent, or Firm*—Lowrie, Lando & Anastasi, LLP

(57) ABSTRACT

A drive signal is generated having at least one pulsed curvilinear waveform shape. This drive signal is applied to a fluid dispenser to cause fluid ejection. Additionally, a drive signal is generated having one or more non-sinusoidal curvilinear waveform shapes. This drive signal is applied to a fluid dispenser to cause fluid ejection. Still further, a drive signal is generated having multiple segments including at least one segment having a curvilinear waveform shape. This drive signal is applied to a fluid dispenser to cause fluid ejection.

41 Claims, 9 Drawing Sheets

$$y_i := -A \cdot \sin\left(\frac{i}{N} \cdot n \cdot \pi\right) \cdot \left(-\alpha \cdot \frac{i}{N} + \beta\right) \qquad 0 < \alpha \le \beta \qquad i := 0, 1 .. N$$

$$y_i := -A \cdot \sin\left(\frac{i}{N} \cdot n \cdot \pi\right) \cdot \exp\left(-\lambda \cdot \frac{i}{N}\right) \qquad \lambda > 0 \qquad i := 0, 1 .. N$$

$$y_i := A \cdot \sin\left(\frac{i}{N} \cdot \pi\right) \qquad i := 0, 1 .. N$$

$$y_i := \frac{A}{\left(\frac{i-\mu}{\frac{\omega}{2}}\right)^2 + 1} \qquad i := 0, 1 .. N$$

$$y_i := A \cdot \exp\left[\frac{-(i-\mu)^2}{2 \cdot \sigma^2}\right] \qquad i := 0, 1 .. N$$

$$y_i := \frac{A \cdot \exp\left[-\left(\frac{i-\mu}{\delta}\right)\right]}{\left[1 + \exp\left[-\left(\frac{i-\mu}{\delta}\right)\right]\right]^2} \qquad i := 0, 1 .. N$$

$$y_0 := 0 \qquad y_i := \frac{A}{i^r} \cdot \exp\left[\frac{-(\ln(i) - \ln(m))^2}{2 \cdot (\ln(s))^2}\right] \qquad r = 1 \qquad i := 1, 2 .. N$$

$$y_N := 0 \qquad y_{N-i} := \frac{A}{i^r} \cdot \exp\left[\frac{-(\ln(i) - \ln(m))^2}{2 \cdot (\ln(s))^2}\right] \qquad r = 1 \qquad i := 1, 2 .. N$$

$$y_i := A \cdot i^p \cdot \exp\left(-\kappa \cdot i^q\right) \quad p = q = 2 \quad \kappa > 0 \quad i := 0, 1 .. N$$

$$y_{N-i} := A \cdot i^p \cdot \exp\left(-\kappa \cdot i^q\right) \quad p = q = 2 \quad \kappa > 0 \quad i := 0, 1 .. N$$

$$y_i := A \cdot i^p \cdot \exp\left(-\kappa \cdot i^q\right) \quad p = 1 \quad q = 2 \quad \kappa > 0 \quad i := 0, 1 .. N$$

$$y_{N-i} := A \cdot i^p \cdot \exp\left(-\kappa \cdot i^q\right) \quad p = 1 \quad q = 2 \quad \kappa > 0 \quad i := 0, 1 .. N$$

METHOD AND APPARATUS FOR FLUID DISPENSING USING CURVILINEAR DRIVE WAVEFORMS

PRIORITY CLAIM

The present application claims priority from U.S. Provisional Application for Patent Ser. No. 60/481,568, filed Oct. 28, 2003, and entitled "Method and Apparatus for Fluid Dispensing Using Curvilinear Drive Waveforms" by James E. Clark, the disclosure of which is hereby incorporated by reference in its entirety.

BACKGROUND

1. Technical Field

The present disclosure relates to controlling liquid dispensers. In specific embodiments, the present disclosure relates to the selection and application of drive waveforms to piezoelectrically actuated drop-on-demand liquid dispensers so as to aspirate and dispense in a known and controlled fashion picoliter range droplets of a liquid (for example, an ink or a liquid containing chemically or biologically active substances).

2. Description of Related Art

Piezoelectrically actuated microdispensers and print heads are used to generate microdrops of various fluids in a wide range of non-contact microdispensing applications, such as ink jet printing, biological microarrays, miniaturized chemical assays, drug dosing, synthetic tissue engineering, rapid prototyping, security printing, micro-manufacturing of optic and electronic components, and precision application of lubricants and other specialty or high value liquids.

These microdispensers and print heads, like drop-on-demand piezo dispensers and ink jet print head devices, include a transducer or transducer array that is typically driven by a pulsed rectilinear or polygonal waveform control signal to cause fluid ejection through a small orifice. Due to complex interactions between the materials and electromechanical structure of the microdispenser, physical and Theological properties of the fluid, applied fluid pressure, and the applied drive waveform, many modes of stable or unstable fluid ejection are possible, such as drops, sprays, or elongated slugs of fluid.

The physical construction of the microdispenser or print head typically is fixed in microdispensing and ink jet printing systems, however fluid properties can vary according to the requirements of the end user's application. In many applications it is necessary or desirable to provide fluid drops, either mono-size or multi-size, having selectable drop volume and drop velocity that are ejected either satellite-free or in a manner such that satellite drops merge relatively quickly with the main drops.

One typical drop-on-demand piezo dispenser comprises a borosilicate glass capillary tube that is heat drawn and cleaved at one end to form an ejection orifice (orifices in the range 30-70 μm are common). A tubular piezoelectric transducer is bonded onto the capillary tube over a second heat drawn fluid restrictor element in the capillary tube. Piezo dispensers of this type are available from a number of sources including PerkinElmer Life & Analytical Sciences (formerly Packard Instrument Company of Downers Grove, Ill. or Packard BioScience of Meriden, Conn.). All piezoelectrically actuated drop-on-demand microdispensing and ink jet devices operate in accordance with the same fundamental squeezing principle: the piezoelectric transducer changes the volume of a fluid chamber within the device in response to an applied voltage pulse to eject a fluid droplet through a small orifice.

Reference is now made to FIG. 1 wherein there is shown a block diagram for a conventional system 10 for producing droplets of a fluid. The system 10 includes at least one piezoelectric drop-on-demand (DOD) dispenser 12 which is actuated in response to an electrical control signal 14 (also referred to as the drive signal) generated by a piezoelectric driver 16. The dispenser 12 may have one of several piezoelectric actuation configurations including, for example, a cylindrical squeezer-type capillary tube piezo dispenser (a microdispenser) for use in dispensing a liquid containing chemically or biologically active substances or an ink jet piezo printing head for use in dispensing a printing ink or specialty fluid. The piezo driver 16 includes a high voltage amplifier capable of generating voltage signals with levels up to about ±150 volts. The piezo driver 16 outputs the control (drive) signal 14 in response to an input signal 20 received from a rectilinear or polygonal pulse generator 18. The pulse generator 18 is configured to synthesize a particular waveform as the input signal 20 having certain known characteristics (height, width, rise time, fall time, delay time, and the like). The input signal 20 waveform is then amplified by the piezo driver 16 for application to the dispenser 12 as the control (drive) signal 14. The piezoelectric transducer within the dispenser 12 responds to the applied control (drive) signal 14 and ejects fluid (generally in the form of one or more droplets) from the orifice.

Oftentimes it is not possible to model or otherwise predetermine drop ejection characteristics with a high degree of predictive accuracy for a particular drive signal waveform with a particular fluid in a particular type of piezo dispenser, microdispenser or print head. Modeling of satellite drop formation and merging behavior is especially difficult to perform and is frequently deficient in predicting these physical phenomena correctly. As interactions between the piezo dispenser, microdispenser or print head, fluid, applied fluid pressure, and applied drive waveform are inherently complex, drive waveforms were principally discovered and developed using empirical methods.

The piezoelectric transducer of a drop-on-demand dispenser (for example, an ink jet device) is typically driven by either a rectilinear or polygonal voltage pulse shape drive signal waveform having a selected one of a variety of unipolar or bipolar and single or multiple pulse configurations. Generally, the shape of the drive signal waveform is related to deformation of the fluid cavity, motion of the fluid meniscus in the ejection passage, drop ejection through the orifice, and subsequent motion of the fluid meniscus. Such rectilinear or polygonal drive signal waveforms have also been used successfully in piezo dispensers (microdispensers) including PerkinElmer Piezo Tips for ejecting a liquid containing chemically or biologically active substances.

FIGS. 2-5 illustrate examples of known rectilinear or polygonal drive pulse shapes for the signal 20 generated by the pulse generator 18 for use in actuating a drop-on-demand piezoelectric dispenser 12 in the system 10 of FIG. 1. The rectangular drive pulse illustrated in FIG. 2 has been used to drive a standard PerkinElmer 70 μm Piezo Tip (the dispenser 12) so as to eject a single droplet having a volume of about 330 picoliters with a speed of about 2 m/sec. The illustrated rectangular drive pulse may have a pulse width of about 30 μsec, and when amplified by the piezo driver 16 to generate the control signal 14 may have a pulse height of about 65 Volts. FIG. 3 illustrates a double-pulse waveform which is taught by U.S. Pat. No. 5,736,994 for driving a piezoelectric shear mode-shared wall ink jet print head. It is known in the art to use such a waveform to drive a conventional drop-on-demand piezo dispenser in a configuration like that illustrated in FIG. 1 so as to eject single droplets using certain combinations of pulse parameters (for example, height, width, rise time, fall time, delay time). FIG. 4 illustrates a bipolar double-pulse waveform which is taught by U.S. Pat. No. 5,124,716. It is known in the art to use this waveform to drive a laminated piezoelectric bender-type ink jet printhead in a configuration like that illustrated in FIG. 1 so as to eject single droplets using certain combinations of pulse parameters (for example, height, width, rise time, fall time, delay time). Lastly, FIG. 5 illustrates a bipolar multi-segment pulse waveform which is taught by U.S. Pat. No. 6,513,894 for use in a configuration like that illustrated in FIG. 1 for the stable ejection by a piezo dispenser of droplets that are smaller than the diameter of the ejection orifice.

Microarraying applications are intrinsically diverse due to several differentiating factors, such as array size, spot density, sample types, buffer solutions, and substrate types, plus capacity and throughput requirements. For example, array sizes vary tremendously, ranging from about 100 to 50,000+ elements. Spot spacing typically decreases as array size increases, and thus a commensurately smaller drop volume is required in order to prevent spot overlapping on the substrate. It is recognized by those skilled in the art that rectilinear or polygonal drive signal-based piezo dispenser systems largely cannot, with respect to the diverse and special needs of microarraying applications, provide a broad range of fluid drop sizes having selectable drop volume and drop velocity, and further that are ejected either satellite-free or in such a manner that satellite drops merge relatively quickly with a main drop.

It is further recognized in the ink jet printing and fluid dispensing art that smaller drop volumes are preferred in some instances. Rectilinear or polygonal drive signal-based piezo ink jet dispenser systems appear to have a low limit drop size which is primarily dependent on orifice size. However, as orifice size decreases in ink jet applications, and thus smaller drops are potentially generated, the danger of clogging increases due to particulates that are carried by the ink (or that are present in the surrounding environment, such as air borne particulates) being dispensed through the smaller orifice. It is therefore desirable to keep the orifice size as large as possible while simultaneously satisfying requirements for smaller drop volumes.

SUMMARY

Embodiments of the present teachings address the foregoing and other needs in the art by utilizing curvilinear drive waveforms for pulsed actuation of the piezoelectric transducer of a fluid dispenser. The fluid dispenser may be, but is not limited to, those types commonly used in ink jet printing devices and/or piezoelectric microdispensers, for example.

An embodiment of the present disclosure includes an apparatus comprising a device that generates a pulsed drive signal having a curvilinear waveform shape and a fluid dispenser responsive to the drive signal to eject fluid.

Also disclosed is a method comprised of generating a pulsed drive signal having a curvilinear waveform shape and dispensing a fluid in response to the drive signal.

Disclosed in an embodiment is a waveform generator that is configurable to generate a selected one of a plurality of curvilinear waveform shapes. A driver receives the selected curvilinear waveform shape and generates a pulsed drive signal having that selected curvilinear waveform shape. An actuated dispenser responds to the drive signal to eject fluid droplets.

A disclosed embodiment utilizes a non-sinusoidal curvilinear drive waveform to actuate a fluid dispenser. The fluid dispenser may be, but is not limited to, those types commonly used in ink jet printing devices and/or piezoelectric microdispensers, for example.

A disclosed embodiment utilizes a pulsed curvilinear drive waveform including plural segments to actuate a fluid dispenser. The fluid dispenser may be, but is not limited to, those types commonly used in ink jet printing devices and/or piezoelectric microdispensers, for example. At least one segment of the drive waveform has a curvilinear waveform shape and the other segments may use the same or different curvilinear, rectilinear and/or polygonal waveforms.

BRIEF DESCRIPTION OF THE DRAWINGS

A more complete understanding of the disclosed methods and apparatus may be acquired by reference to the following Detailed Description when taken in conjunction with the accompanying Drawings wherein.

DETAILED DESCRIPTION OF THE DRAWINGS

Figure 6:
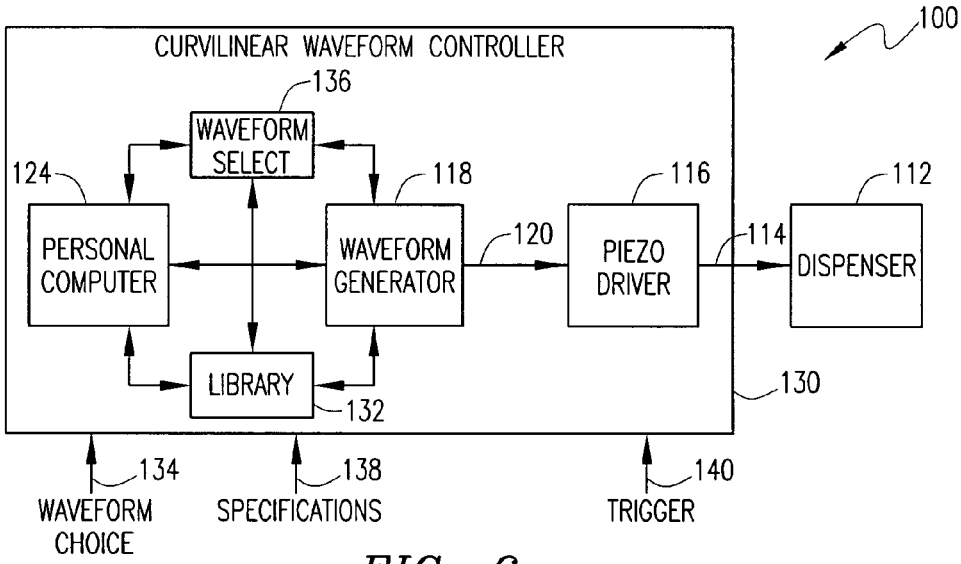
FIG. 6 is a block diagram illustrating a system for producing droplets of a fluid in accordance with an embodiment of the present teachings.

Reference is now made to FIG. 6 where there is shown a block diagram of a system 100 for producing droplets of a fluid in accordance with an embodiment of the present teachings. The system 100 includes at least one piezoelectric drop-on-demand dispenser 112 which is actuated in response to an electrical control signal 114 (also referred to as a drive signal) generated by a piezoelectric driver 116.

Although the illustrated embodiments show piezoelectric dispensers, it can be understood that the present teachings are not limited to dispensers containing piezo transducers, and other electromechanical transducers can be used, for example, magnetostrictive and electrostrictive transducers. The illustrated dispenser 112 may have one of several piezoelectric actuation configurations including, for example, a squeezer-type capillary tube piezo dispenser (a microdispenser) for use in dispensing a liquid containing chemically or biologically active substances (for example, in a microarraying application) or a piezoelectric ink jet print head for use in dispensing a printing ink or specialty liquid. Accordingly, as provided herein, references to a fluid dispenser can include, but are not limited to, drop-on-demand or continuous jet dispensers that can dispense various types of fluids to various types of surfaces, for example, fluids used in assays to be deposited on a surface and/or a container, ink to be deposited on a surface such as paper, and/or other types of fluids to be deposited on other types of surfaces. Accordingly, a fluid dispenser can be understood to include ink jet print heads, where such example is provided for illustration and not limitation.

One embodiment of the illustrated driver 116 includes a high voltage wideband amplifier (for example, having the operating characteristics of a Krohn-Hite 7600M type device or the like) capable of generating voltage signals with levels up to at least about ±150 volts. The piezo driver 116 provides as output a control (drive) signal 114 in response to an input signal 120 received from a waveform generator 118 (for example, having the operating characteristics of a Pragmatic 2414B type device or the like) which may be interfaced with a personal computer 124 (or perhaps a microcontroller or data processing device or programmable logic circuit or other processor-controlled device). The illustrated waveform generator 118 is configured to synthesize a pulsed or continuous waveform as the input signal 120 having a certain curvilinear shape and possessing specified characteristics (amplitude, width, rise time, fall time, delay time, decay constant, mean, standard deviation, D.C. offset, multiple segments and the like shape-affecting factors). Data defining the particular curvilinear waveform may be supplied by the personal computer 124 which is interfaced to the waveform generator 118. The input signal 120 waveform is then amplified by the piezo driver 116 for application to the dispenser 112 as the control (drive) signal 114. The piezoelectric transducer within the dispenser 112 responds to the applied control signal 114 and ejects fluid (generally in the form of one or more droplets) from the orifice.

Figure 19:
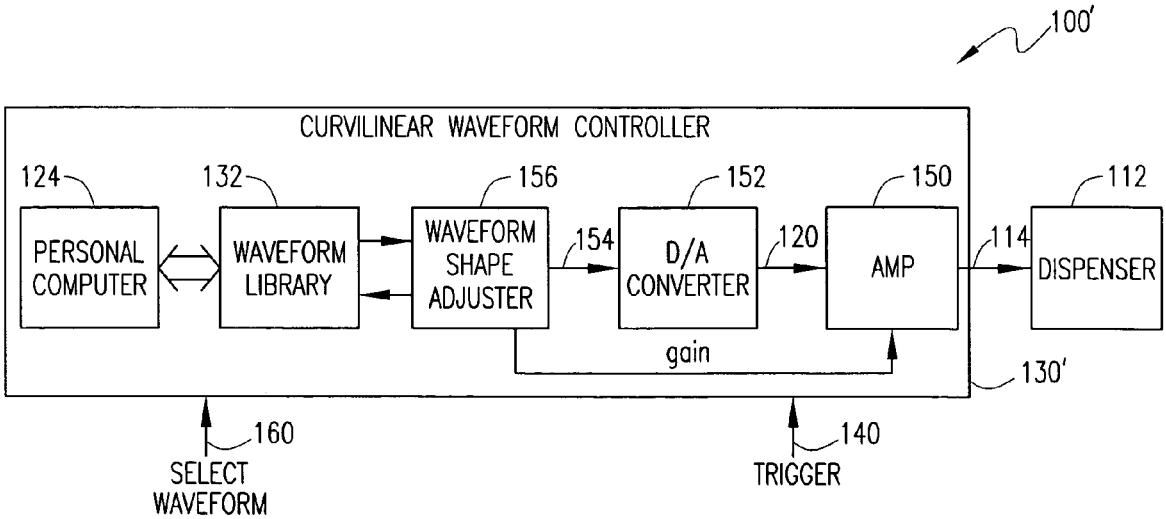
FIG. 19 is a block diagram illustrating a system for producing droplets of a fluid in accordance with an embodiment of the present teachings.
Figure 2:
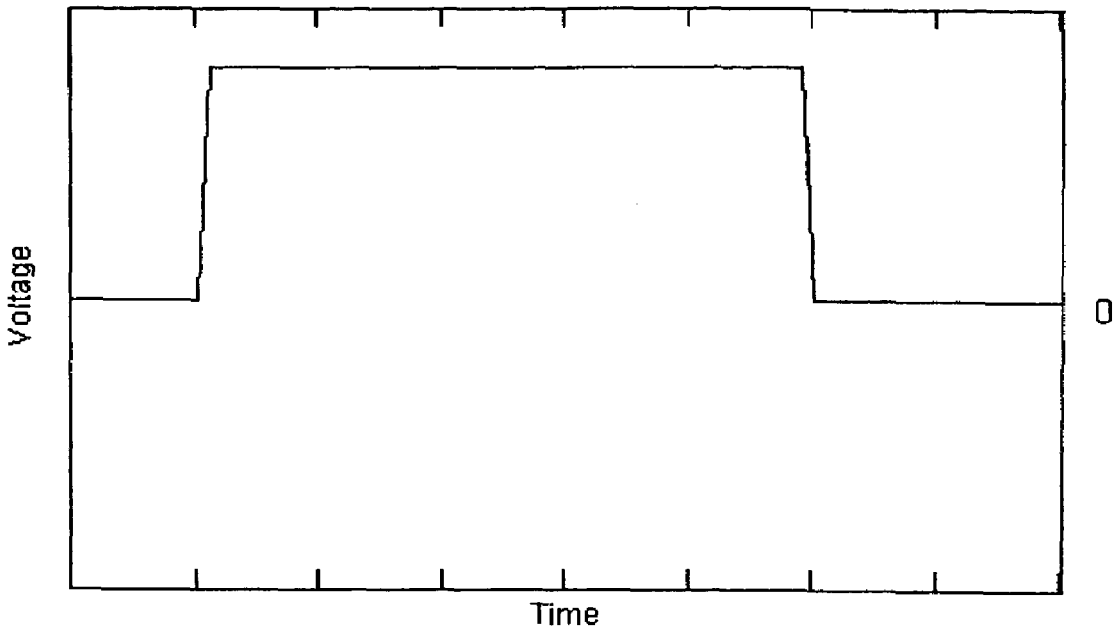
FIG. 2 (PRIOR ART)
FIGS. 2-5 are waveform diagrams illustrating various rectilinear or polygonal drive pulse shapes for use as control signals to actuate a drop-on-demand piezoelectric dispenser like that shown in FIG. 1.
Figure 3:
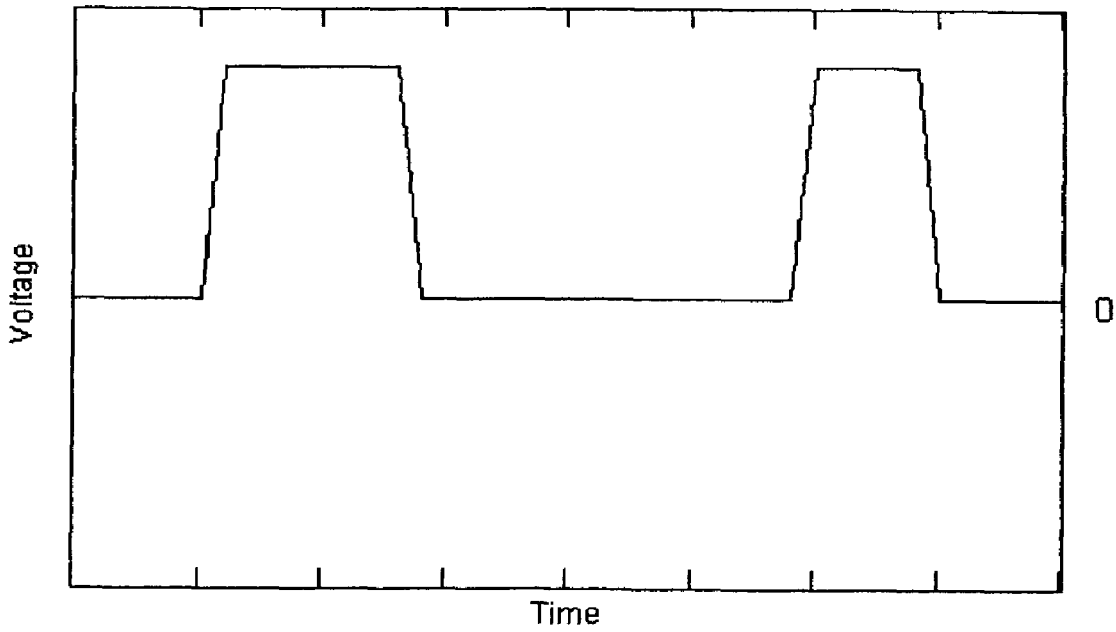
FIG. 3 (PRIOR ART)
Figure 4:
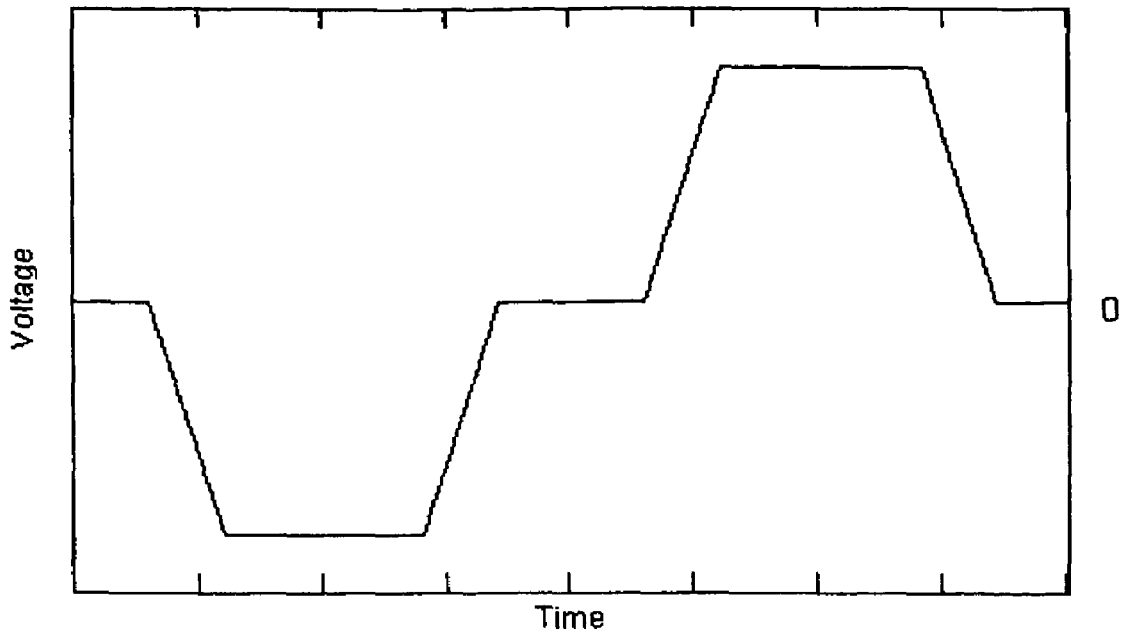
FIG. 4 (PRIOR ART)
Figure 5:
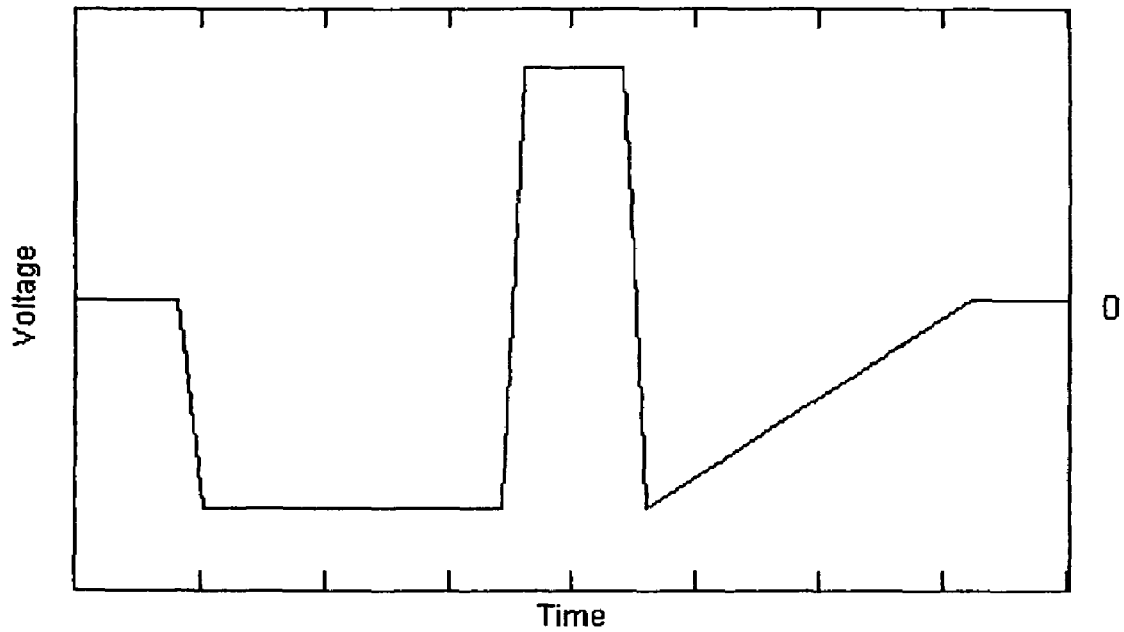
FIG. 5 (PRIOR ART)

The piezo driver 116, waveform generator 118 and personal computer 124 together accordingly form a curvilinear waveform controller 130 which is connected to the piezoelectric dispenser 112. It will be understood by those skilled in the art that the controller 130 need not be configured exactly in the manner illustrated by FIG. 6, or utilize the exemplary Krohn-Hite amplifier, Pragmatic waveform generator or personal computer devices, but can be otherwise configured to produce at least one curvilinear drive waveform to drive the (piezoelectric) transducer within the dispenser 112 to produce a drop ejection characteristic (for example, drop volume, drop velocity, etc.) for a given liquid to be dispensed. An alternative configuration for the system 100, to be described later in detail, is illustrated in FIG. 19.

In accordance with one embodiment, the curvilinear waveform controller 130 is designed to produce a certain curvilinear drive waveform having a certain curvilinear shape and possessing specified curve characteristics to drive a certain type of (piezoelectric) transducer within the dispenser 112 to produce a desired drop ejection characteristic (for example, drop volume, drop velocity, etc.) for a given liquid. In this way, the controller 130 is specifically tailored for use in a certain dispensing application to provide the aforementioned drop ejection characteristic results with respect to a given dispenser type, fluid type, drop volume need and/or drop velocity need. To this end, the waveform generator 118 may comprise a function specific generator configured to produce the desired waveform shape for a given application. Alternatively and/or additionally, the personal computer 124 may be configured with waveform data for the desired waveform shape for the application to control the operation of the waveform generator 118.

In accordance with another embodiment, the curvilinear waveform controller 130 is configurable to produce one of a plurality of user-selectable curvilinear drive waveforms. At least some of such waveforms could have a certain curvilinear shape and possess specified curve characteristics for driving a certain type of piezoelectric transducer within the dispenser 112 to produce a desired drop ejection characteristic (for example, drop volume, drop velocity, etc.) for a given liquid. In this way, the controller 130 can be conveniently used in a plurality of dispensing applications by reconfiguring the curvilinear drive waveform data processed by the controller to generate the drive signal. A different and specifically designed controller 130 accordingly need not be provided to account for changes in application, changes in dispensed fluid, changes in drop volume needs and/or changes in drop velocity needs. For this implementation, the waveform generator 118 operates in a manner responsive to personal computer 124 supplied waveform data. In an embodiment, waveform data for each desired curvilinear waveform is stored by the personal computer 124 and is selected through the computer for provision to the waveform generator 118 so as to configure a specific curvilinear drive operation of the controller 130. Alternatively and/or additionally, the waveform generator 118 could store the waveform data for each desired curvilinear waveform, and selection of a certain one of the waveforms for the input signal 120 could be made directly through the waveform generator without need for the personal computer 124. In either case, a menu of possible curvilinear waveform shapes could be presented to the user, with the user selecting from that menu the desired shape as well as pertinent waveform shape-related parameters (such as, for example, amplitude, width, rise time, fall time, delay time, decay constant, mean, standard deviation, D.C. offset and the like shape-affecting factors). These shape-related parameters are adjustable in either an incremental or continuous manner so as to achieve the desired drop ejection characteristic (for example, the stable ejection of uniform, satellite-free fluid drops of a given fluid in a certain fluid dispensing or ink jet printing application).

An embodiment further includes having two or more waveform segments within a multi-segmented curvilinear drive waveform. Each waveform segment in the multi-segmented waveform has a certain curvilinear waveform shape and is defined by certain parameters. The included waveform segments may have the same general curvilinear waveform shape and each segment may have different shape-affecting parameters. Alternatively, the included waveform segments may include at least one curvilinear waveform shape and one or more other waveform segments that may include curvilinear, rectilinear and/or polygonal waveform shapes in which each waveform segment may have a different shape and/or different shape-affecting parameters. Use of plural segments in the drive waveform may be beneficial in some dispensing applications where a given waveform shape (and its parameters) is found to be useful in forming and ejecting a drop having certain desirable characteristics (for example, size) while another waveform shape (and its parameters) is found to be useful in controlling meniscus oscillations following a main drop ejection so as to inhibit the ejection of secondary or satellite drops.

In support of the foregoing implementations, the controller 130 could include a library 132 storing waveform data. This library 132 could be accessed by, and perhaps located within, the personal computer 124 and/or the waveform generator 118. This library 132 need not only contain data relating to curvilinear drive waveforms, but may also contain data relating to rectilinear and polygonal drive waveforms (such as those illustrated in FIGS. 2-5) as well as other non-curvilinear drive waveforms for use in piezoelectric dispensing applications. In operation, the controller 130, responsive to a user choice 134 (from the presented menu, for example), would obtain from the library 132 the data relating to the drive waveform selected by the user. This choice is made such that the chosen drive waveform will, for the type of dispenser 112 present and the fluid at issue, produce the user's desired, specified and/or required drop ejection characteristics for a given application. Utilizing that data, the controller 130 would generate the corresponding drive waveform as the control signal 114 for application to the (piezoelectric) transducer within the dispenser 112. The dispenser 112 responds thereto by ejecting the fluid at issue (generally in the form of one or more droplets) from the orifice.

In accordance with still another embodiment, the controller 130 includes a drive waveform selection functionality 136 that is operable to make, or assist the user in making, the correct or otherwise best possible drive waveform selection from the library 132 in view of certain user input dispensing application specifications 138. These specifications 138 may include, for example, user specification of one or more of the following variables: type of dispenser 112 (for example, Piezo Tip, ink jet print head, and/or specification of orifice size), type of fluid (for example, and in general, ink or biological fluid, or perhaps more specifically a type/brand/color of ink or certain kind of biological fluid or specialty fluid), the desired/required drop volume (in either a range, minimum or maximum variable), and/or the drop velocity (in either a range, minimum or maximum variable). Other variable/parameter specification which is relevant to the application and its needs in terms of generating a drop having certain desired or required drop ejection characteristics can be provided or input as a user specification 138 and accounted for by the functionality 136. In operation, the functionality 136, responsive to the user specifications 138, would identify one of the drive waveforms from the library 132. The controller 130, responsive to the selection made by the functionality 136, would then obtain from the library 132 the data relating to the drive waveform identified by the functionality 136. Again, this selection can be made by the functionality 136 (for example, processor instructions) such that the drive waveform will, for the given user specifications 138 (such as, for example, type of dispenser 112 present, the fluid at issue, desired drop size, and/or desired drop velocity) produce specified drop ejection characteristics. Utilizing that data, the controller 130 can generate the corresponding drive waveform as the control signal 114 for application to the piezoelectric transducer within the dispenser 112. The dispenser responds thereto by ejecting the fluid (generally in the form of one or more droplets) from the orifice. In an embodiment, this selection functionality 136 could be implemented with processor-readable instructions using the personal computer 124. One option would include programming the personal computer 124 with a decision tree which could be executed to receive the user specifications 138 and then choose the drive waveform from the library 132 based on the tree decision-driving parameters. The selection functionality 136 could alternatively be provided by the waveform generator 118 as an enhanced operating feature. The functionality 136 still further could select the pertinent waveform shape-related parameters (such as, for example, amplitude, width, rise time, fall time, delay time, decay constant, mean, standard deviation and the like shape-affecting factors) for the drive waveform identified/chosen from the library 132. These shape-related parameters are adjustable in either an incremental or continuous manner so as to achieve the desired drop ejection characteristic (for example, the stable ejection of uniform fluid drops of a given fluid in a certain fluid dispensing or ink jet printing application).

Reference is now made to FIGS. 7-18 which illustrate exemplary curvilinear waveforms for use in the system 100 of FIG. 6. The illustrated curvilinear drive waveforms are referenced according to mathematical functions or distributions that define their essential shapes, with the exception that standard normalization or scaling factors commonly used with these functions or distributions have been replaced by an amplitude A. A unique amplitude A may be chosen to be compatible with the electronic controller 130 design in general, and more specifically with respect to the type of driver and/or dispenser used in the application and with further consideration given to the type of fluid being dispensed. These curvilinear drive waveform shapes are defined by the mathematical formulae appearing in FIGS. 7-18 using the following nomenclature and additional explanatory notes:

- $y_i$ is the $i^{th}$ data element in a waveform data file corresponding to time $t_i=i/f_s$ for i=0, 1 . . . N;
- N+1 is the total number of data elements comprising the waveform;
- $t_N$ is the pulse duration;
- $f_s$ is the sampling frequency;
- A is the amplitude;
- n is an integral number of sine half-cycles in one pulse duration;
- $\alpha$, $\beta$ are linear decay constants;
- $\lambda$ is an exponential decay constant;
- $\mu$ is the mean;
- $\omega$ is the full width at half-amplitude;
- $\sigma$ is the standard deviation;
- $\delta$, $\kappa$ are shape factors;
- m is the geometric mean;
- s is the geometric standard deviation; and
- p, q, r are exponents.

Although not shown in FIGS. 7-18, it will be understood that each of the waveform formulae may further include the addition of a constant representing a D.C. offset value. This constant may take on any value (positive, negative or zero) and be selected to have a desired or needed effect on drop formation.

Figure 7:
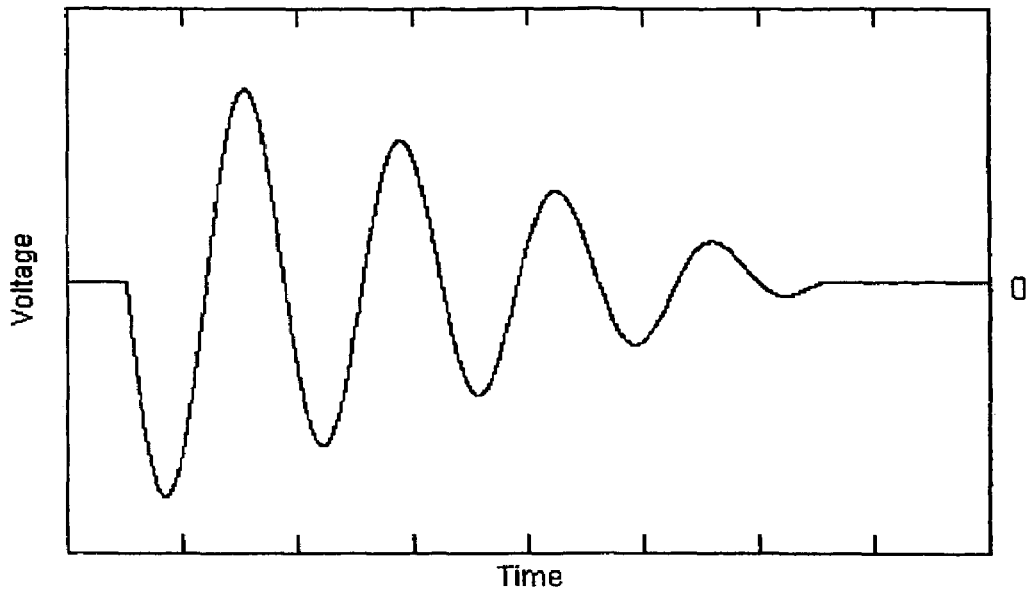
FIGS. 7-18 illustrate exemplary curvilinear waveforms for use in a system such as FIG. 6.

FIG. 7 illustrates a "Linearly Damped Inverted Sine" curvilinear drive waveform wherein n is an integer $\geqq 3$. The special case for n=9 is illustrated in FIG. 7. A drive signal created from this curvilinear drive waveform could have a pulse height in the range of 50 to 150 volts, a pulse duration in the range of 100 to 500 μsec and the following shape parameters $n\approx 5$, $\alpha\approx 1$, $\beta\approx 1$ and $N\approx 2209$ for actuating the dispenser 112 to eject drops.

Figure 8:
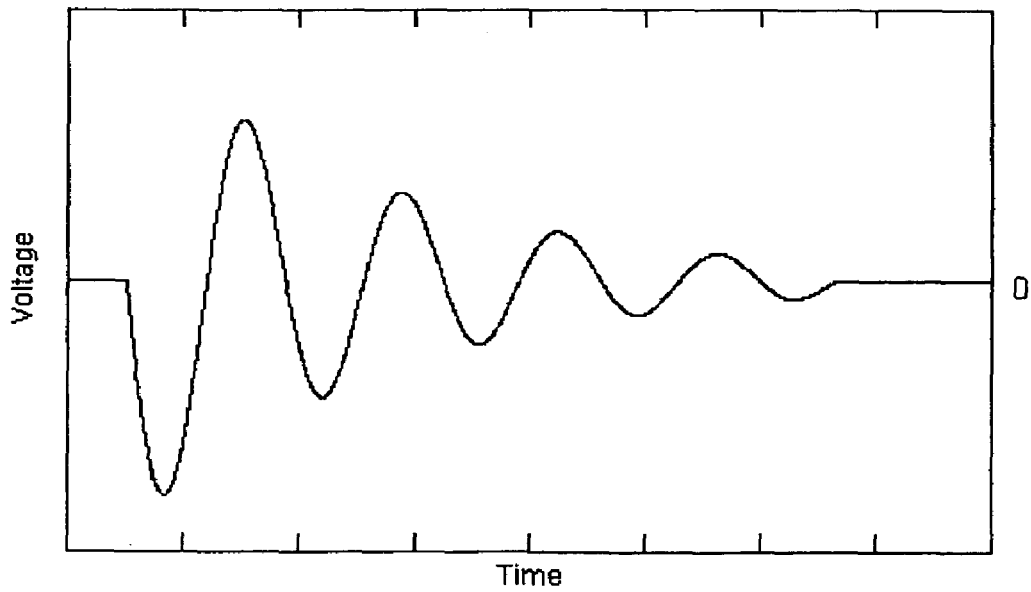

FIG. 8 illustrates an "Exponentially Damped Inverted Sine" curvilinear drive waveform wherein n is an integer $\geqq 3$. The special case for n=9 is illustrated in FIG. 8. As an example, a drive signal created from this curvilinear drive waveform having a pulse height of 71 volts, a pulse duration of 136 μsec and the following shape parameters n=5, $\lambda$=2.7 and N=900 has been shown to generate a 100 picoliter water drop, having satellite-free drop separation, from a standard production 70 μm Piezo Tip (PerkinElmer serial number A07970) at a drop speed of approximately 2.0 m/sec and a dispensing pressure of −10 mbar. Experimentation has further shown these waveform parameters in certain situations being capable of producing an approximately 80 picoliter water drop. A smaller drop volume may also be obtained by applying a similar drive signal that may have different adjusted or selected shape parameters to a Piezo Tip having an orifice diameter that is less than 70 μm. It should further be noted that the listed waveform parameters are exemplary.

Figure 9:
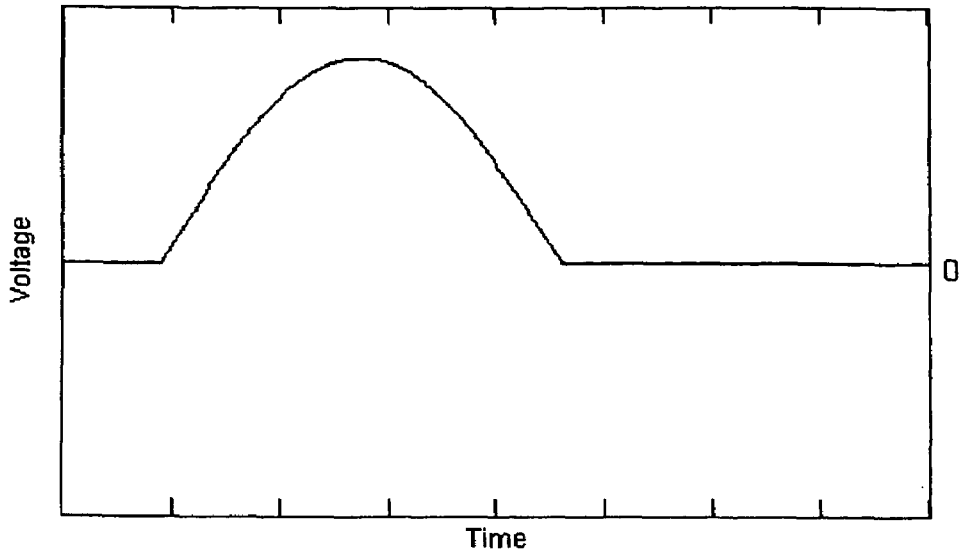

FIG. 9 illustrates a "Rectified Sine" curvilinear drive waveform. As an example, a drive signal created from this curvilinear drive waveform having a pulse height of 64 volts, a pulse width of 13 μsec (fill width, half maximum) has been shown to generate a 180 picoliter water drop, having satellite-free drop separation, from a standard production 70 μm Piezo Tip (PerkinElmer serial number A07970) at a drop speed of approximately 2.0 m/sec and a dispensing pressure of −10 mbar. A smaller drop volume may be obtained by applying a similar drive signal that may have different adjusted or selected shape parameters to a Piezo Tip having an orifice diameter that is less than 70 μm. More specifically, a rectified sine curvilinear drive waveform has been shown to produce a 50 picoliter drop from a PerkinElmer Piezo Tip having a 40 μm orifice. It should further be noted that the listed waveform parameters are exemplary.

Figure 10:
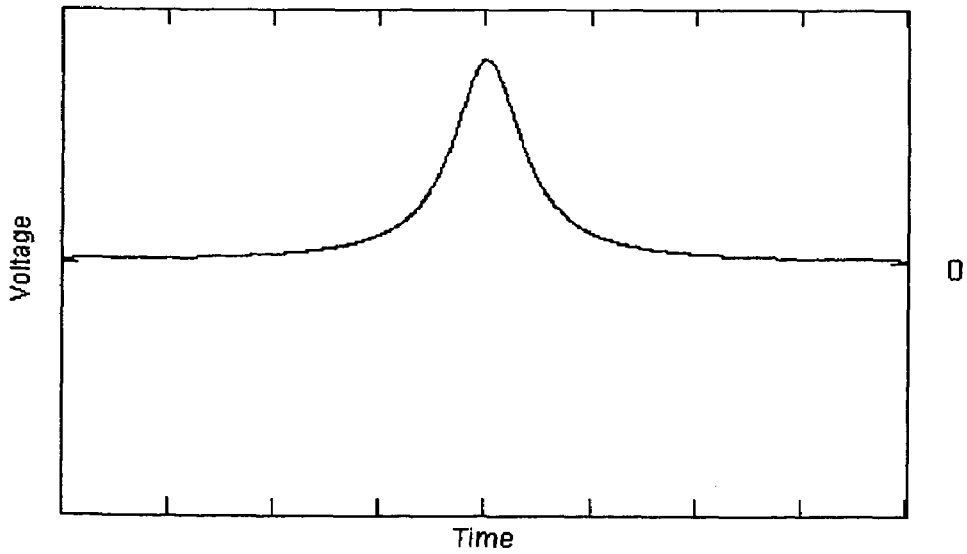

FIG. 10 illustrates a "Lorentzian" (or Cauchy) curvilinear drive waveform wherein $\mu=N/2$ and $\omega \leqq N/9$ are useful values for waveforms of practical interest. As an example, a drive signal created from this curvilinear drive waveform having a pulse height of 95 volts, a pulse width of 9 μsec (full width, half maximum) has been shown to generate a 240 picoliter water drop, having satellite-free drop separation, from a standard production 70 μm Piezo Tip (PerkinElmer serial number A07970) at a drop speed of approximately 2.0 m/sec and a dispensing pressure of −10 mbar. A smaller drop volume may be obtained by applying a similar drive signal that may have different adjusted or selected shape parameters to a Piezo Tip having an orifice diameter that is less than 70 μm. It should further be noted that the listed waveform parameters are exemplary.

Figure 11:
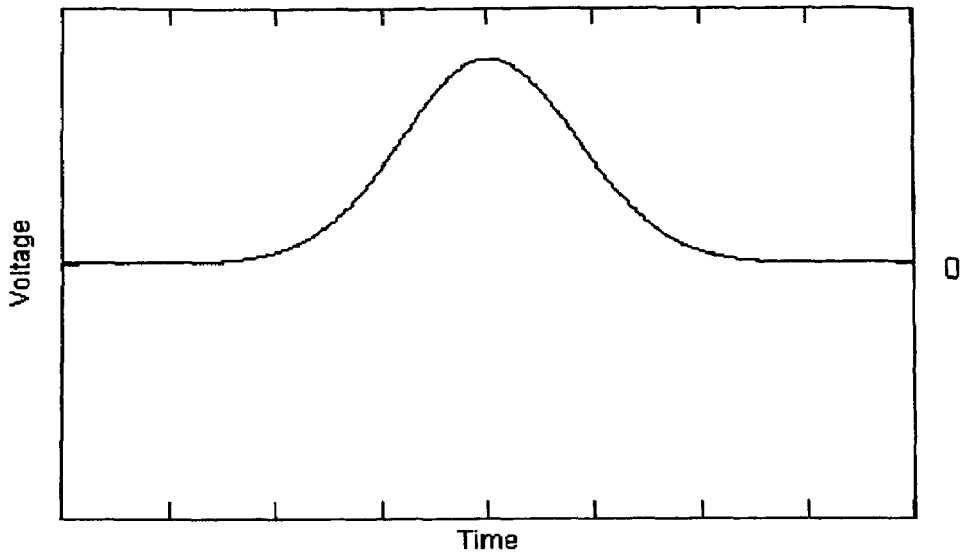

FIG. 11 illustrates a "Gaussian" curvilinear drive waveform wherein $\mu=N/2$ and $\sigma \leqq N/7$ are useful values for waveforms of practical interest. As an example, a drive signal created from this curvilinear drive waveform having a pulse height of 73 volts, a pulse width of 12 μsec (full width, half maximum) has been shown to generate a 190 picoliter water drop, having satellite-free drop separation, from a standard production 70 μm Piezo Tip (PerkinElmer serial number A07970) at a drop speed of approximately 2.0 m/sec and a dispensing pressure of −10 mbar. A smaller drop volume may be obtained by applying a similar drive signal that may have different adjusted or selected shape parameters to a Piezo Tip having an orifice diameter that is less than 70 μm. It should further be noted that the listed waveform parameters are exemplary.

Figure 12:
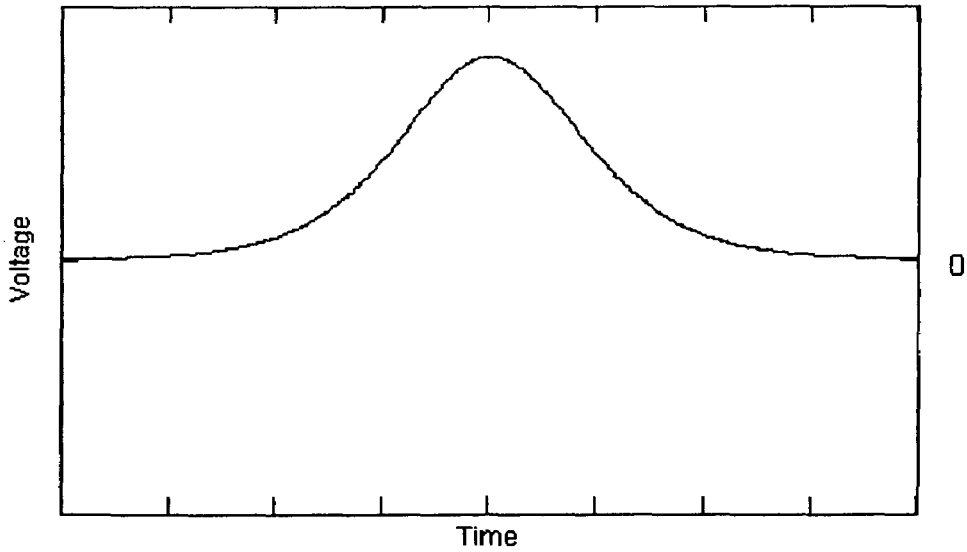

FIG. 12 illustrates a "Logistic" curvilinear drive waveform wherein $\mu=N/2$ and $\delta \approx N/14$ are useful values for waveforms of practical interest. A drive signal created from this curvilinear drive waveform could have a pulse height in the range of 50 to 150 volts, a pulse duration in the range of 5 to 30 μsec and the following shape parameters N=500, $\mu=250$, and $\delta \approx 18$ for actuating a 70 μm Piezo Tip dispenser 112 to eject drops.

Figure 13:
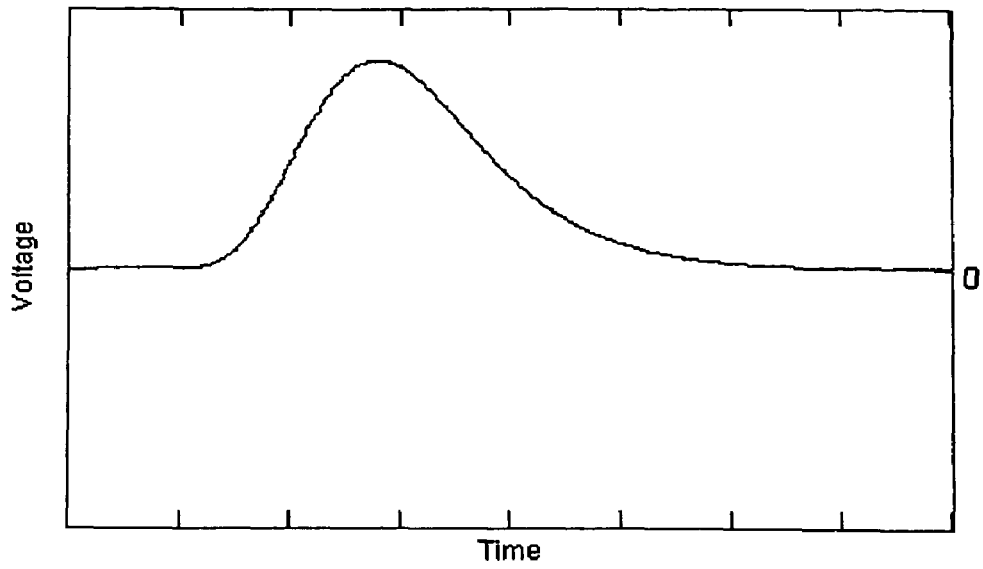

FIG. 13 illustrates a "Lognormal" curvilinear drive waveform wherein r=1 corresponds to a lognormal distribution function, whereas other $r \geqq 0$ define a generalized class of functions with similar shapes. As an example, a drive signal created from this curvilinear drive waveform having a pulse height of 72 volts, a pulse width of 17 μsec (full width, half maximum) has been shown to generate a 140 picoliter water drop, having satellite-free drop separation, from a standard production 70 μm Piezo Tip (PerkinElmer serial number A07970) at a drop speed of approximately 2.0 m/sec and a dispensing pressure of −10 mbar. A smaller drop volume may be obtained by applying a similar drive signal that may have different adjusted or selected shape parameters to a Piezo Tip having an orifice diameter that is less than 70 μm. It should further be noted that the listed waveform parameters are exemplary.

Figure 14:
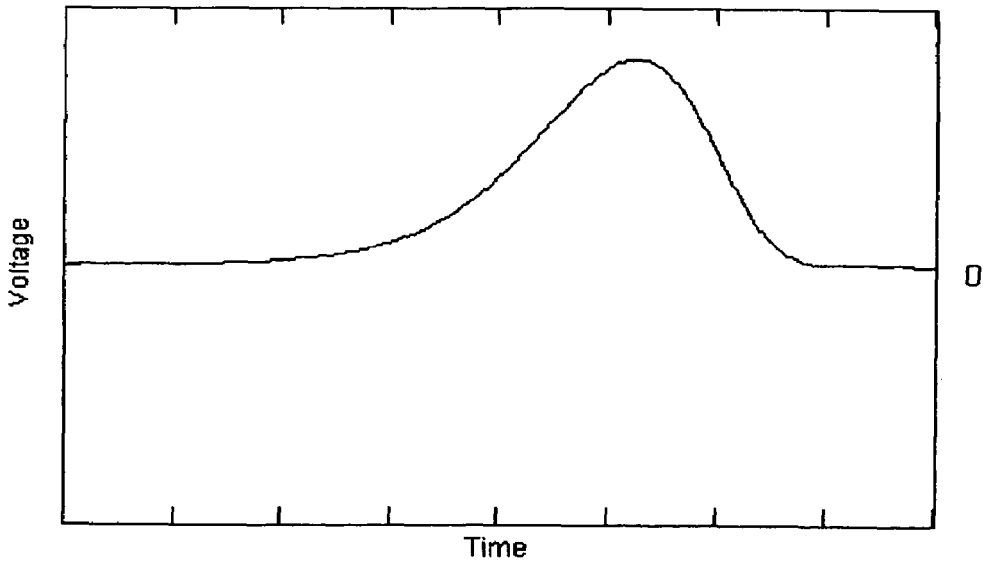

FIG. 14 illustrates an "Inverse Lognormal" curvilinear drive waveform where r=1 corresponds to an inverse lognormal distribution function, whereas other $r \geqq 0$ define a generalized class of functions with similar shapes. As an example, a drive signal created from this curvilinear drive waveform having a pulse height of 89 volts, a pulse width of 9 μsec (full width, half maximum) has been shown to generate a 140 picoliter water drop, having satellite-free drop separation, from a standard production 70 μm Piezo Tip (PerkinElmer serial number A07970) at a drop speed of approximately 2.0 m/sec and a dispensing pressure of −10 mbar. A smaller drop volume may be obtained by applying a similar drive signal that may have different adjusted or selected shape parameters to a Piezo Tip having an orifice diameter that is less than 70 μm. It should further be noted that the listed waveform parameters are exemplary. In can be noted that curvilinear drive waveforms like the inverse lognormal waveform have been shown to produce drops over a broad range of volumes (for example, from 140 to 280 picoliters) by adjusting waveform parameters such as pulse height and pulse width. Similar results over different drop volume ranges are possible with respect to each member of the class of curvilinear drive waveforms described herein.

Figure 15:
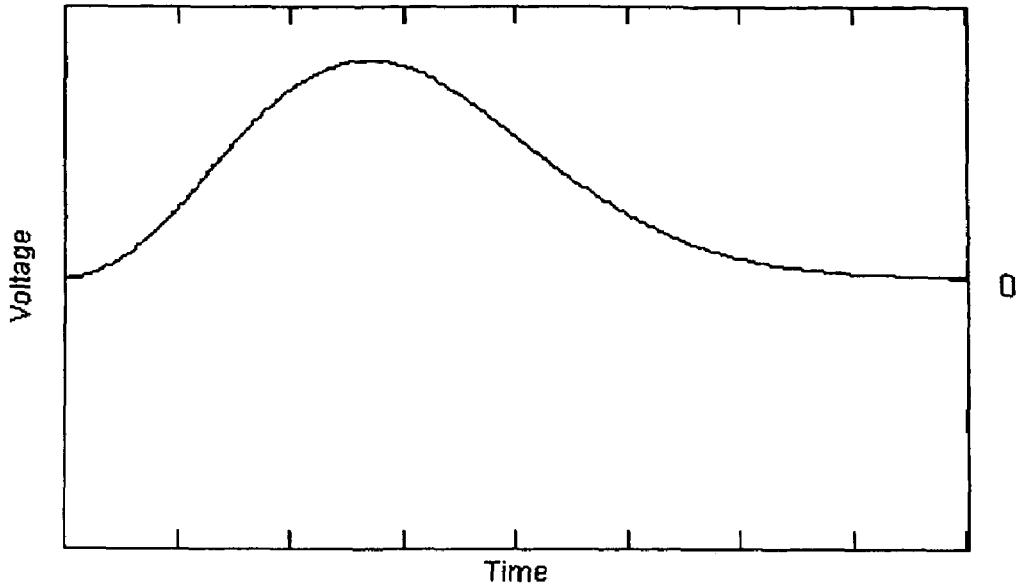

FIG. 15 illustrates a "Maxwell" curvilinear drive waveform wherein p=q=2 corresponds to a Maxwell distribution function, whereas other p>0 and q>0 define a generalized class of functions with similar shapes. A drive signal created from this curvilinear drive waveform could have a pulse height in the range of 50 to 150 volts, a pulse duration in the range of 40 to 240 μsec and the following shape parameters N=300, p=q=2, and $\kappa=0.0001$ for actuating a 70 μm Piezo Tip dispenser 112 to eject drops.

Figure 16:
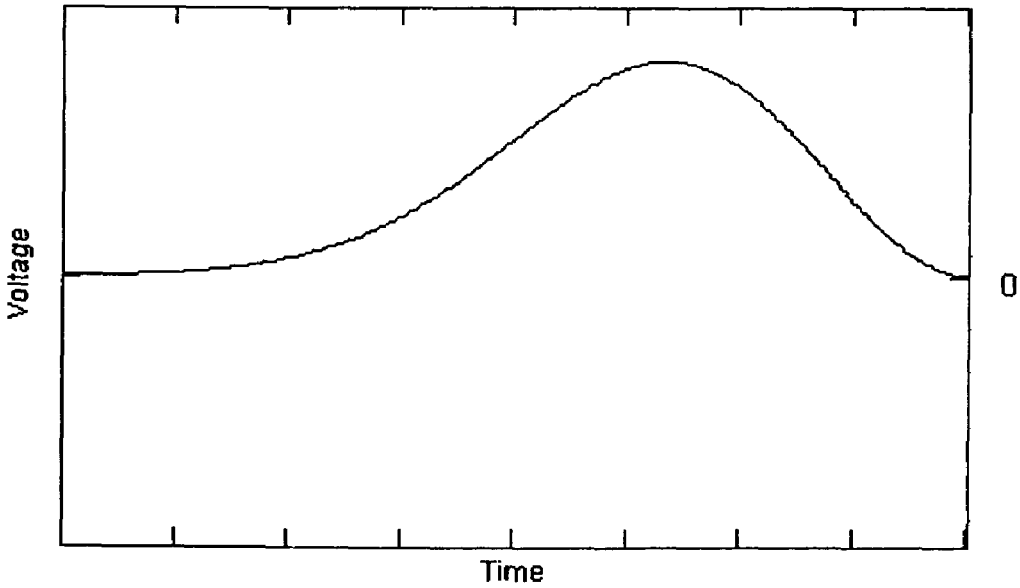

FIG. 16 illustrates an "Inverse Maxwell" curvilinear drive waveform wherein p=q=2 corresponds to an inverse Maxwell distribution function, whereas other p>0 and q>0 define a generalized class of functions with similar shapes. A drive signal created from this curvilinear drive waveform could have a pulse height in the range of 50 to 150 volts, a pulse duration in the range of 40 to 240 μsec and the following shape parameters N=300, p=q=2, and $\kappa=0.0001$ for actuating a 70 μm Piezo Tip dispenser 112 to eject drops.

Figure 17:
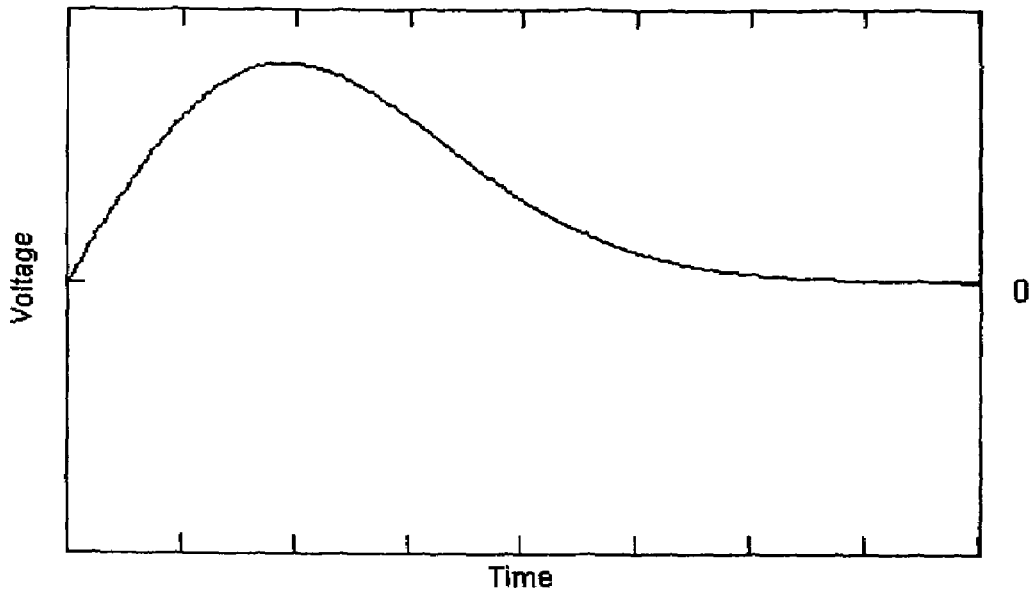

FIG. 17 illustrates a "Rayleigh" curvilinear drive waveform wherein p=1 and q=2 correspond to a Rayleigh distribution function, whereas other p>0 and q>0 define a generalized class of functions with similar shapes. A drive signal created from this curvilinear drive waveform could have a pulse height in the range of 50 to 150 volts, a pulse duration in the range of 40 to 240 μsec and the following shape parameters N=300, p=1, q=2, and $\kappa=0.0001$ for actuating a 70 μm Piezo Tip dispenser 112 to eject drops.

Figure 18:
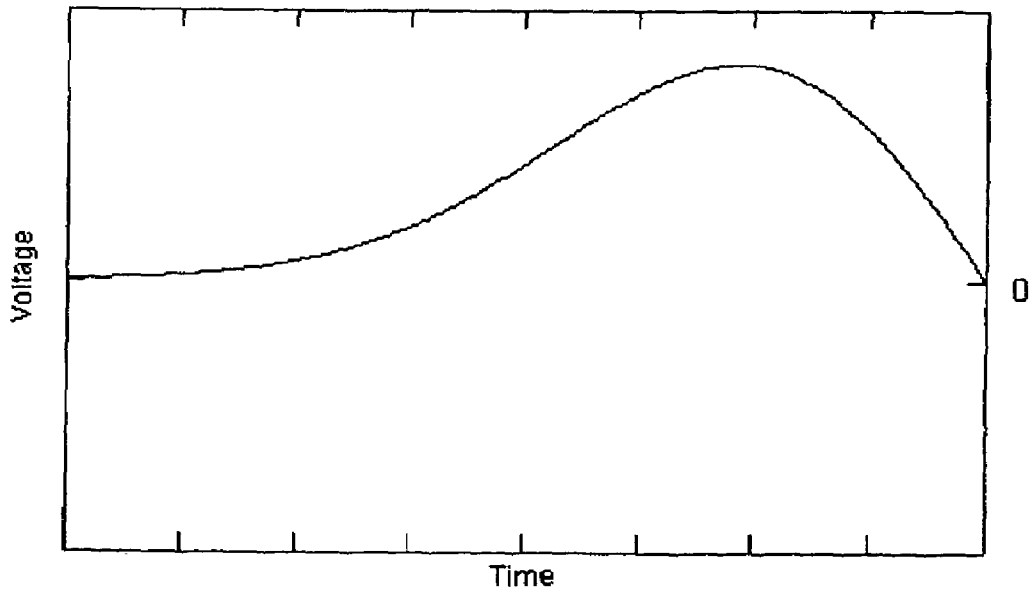

FIG. 18 illustrates an "Inverse Rayleigh" curvilinear drive waveform wherein p=1 and q=2 correspond to an inverse Rayleigh distribution function, whereas other p>0 and q>0 define a generalized class of functions with similar shapes. A drive signal created from this curvilinear drive waveform could have a pulse height in the range of 50 to 150 volts, a pulse duration in the range of 40 to 240 μsec and the following shape parameters N=300, p=1, q=2, and $\kappa=0.0001$ for actuating a 70 μm Piezo Tip dispenser 112 to eject drops.

It is noted that FIGS. 13-18 depict special cases, as indicated, of more general curvilinear functions. It will be understood that drive waveforms that can be generated from the generalized functions, as well as their special cases, are considered curvilinear drive waveforms suitable for use in the system 100 of FIG. 6 and thus are within the scope of the present teachings. Although specific parameters are not provided for exemplary drop production for each of the foregoing curvilinear drive waveforms, it will be understood that through experimentation, parameter values can be discerned which would provide for stable drop generation having a certain drop volume or range of drop volumes for each waveform and with respect to each of perhaps a plurality of different dispenser types.

The harmonic compositions of curvilinear drive waveforms in general, such as determined by Fourier analysis, are different from the harmonic compositions of rectilinear and/or polygonal waveforms (for example, the rectilinear and polygonal waveforms shown in FIGS. 2-5). Due to differences in harmonic composition, it follows that the coupling of the curvilinear drive waveforms with the vibration modes of the ejected fluid and the electro-mechanical structure of the particular dispenser used would be different as well. Upon selection of waveform shape parameters and associated time durations, curvilinear waveforms can cause fluid cavity deformations and meniscus motions that result in improved drop formation and separation characteristics, such as satellite-free drop ejection and/or improved satellite merging, for various ranges of drop volumes and drop speeds. In particular, these desirable drop ejection characteristics can be achieved over relatively broad ranges of pulse shape adjustments for particular dispenser or print head, fluid, and waveform combinations.

Accordingly, it can be understood that the present teachings can allow for increased ranges of drop volumes and drop velocities to provide, for example, smaller drops that can be used to make higher density microarrays, or larger drops can be used to make lower density microarrays in a microarraying instrument; and increased ranges of pulse shape parameters that provide stable, satellite-free drop ejection such that, for example, drop misplacement errors in microarrays caused by satellite formation can be reduced or eliminated.

Figure 1:
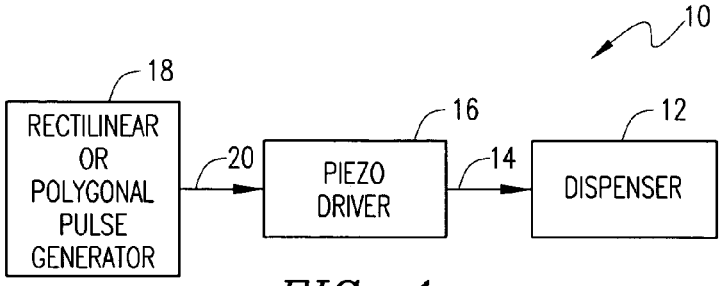
FIG. 1 (PRIOR ART)
FIG. 1 is a block diagram illustrating a conventional system for producing droplets of a fluid.

Reference is now once again made to FIG. 1. Some controllers utilize a single rectilinear or polygonal drive waveform that was developed for a particular type of dispenser or print head for use with particular fluid types to produce drops at a particular volume and speed. With reference now to FIG. 6, embodiments of the present teachings include an electronic waveform controller 130 that selectively utilizes one of a multiplicity of different drive waveform types (preferably of the curvilinear type, but perhaps additionally including rectilinear or polygonal types as well) in order to produce broader ranges of drop volumes and speeds for a multiplicity of fluid types as used in a multiplicity of dispensers or print heads.

To accommodate the broadest possible range of end user applications, a waveform controller 130 can be incorporated into a fluid dispensing or ink jet printing system that can be used to select the drive waveform type and to select or adjust its waveform shape parameters, such as amplitude, width, rise time, fall time, decay constant, mean, standard deviation, or other shape factors, to enable stable drop ejection characteristics, such as drop volume, drop velocity, and satellite configuration, that are suitable for the fluid being dispensed. The specific drive waveform utilized can be chosen manually (see, choice input 134), or it can be selected automatically according to predetermined criteria (for example, as specified in a decision tree) either stored or embedded in the controller 130 (see, specification input 138).

The waveform controller 130 can also store and selectively provide a number of distinctly different drive waveform types that either excite or fail to excite different vibration modes that naturally occur in the fluid being dispensed and in the electromechanical structure of the dispenser or print head being used. Typically the shape of each drive waveform type being utilized can be adjusted to provide particular ranges of drop volumes and drop velocities. Including a multiplicity of different drive waveform types in the waveform controller 130 enables the broadest range of drop volumes and drop velocities to be dispensed from a particular dispenser or print head type for the multiplicity of fluid types that can be used to satisfy a wide range of end user applications.

The aforementioned waveform controller 130 can further enable fluid dispensing from a multiplicity of dispenser or print head variants, such as those having different orifice diameters, orifice profiles, fluid cavity lengths, or material constructions. Such geometric and material differences are related to differences in the vibration modes that naturally occur in the electromechanical structure of the dispenser or print head and interactions with the fluid being dispensed.

A controller 130 that incorporates a multiplicity of drive waveform types having adjustable shape parameters can thus facilitate increased ranges of drop volumes and drop velocities from either a particular dispenser or print head or a multiplicity of dispensers or print head types (for example, low and high density microarrays can be made in the same microarraying instrument using microdispensers with either the same or different orifice sizes); and enable a wider range of sample types to be dispensed (for example, more end user applications can be satisfied).

In one embodiment, configuration and use of the controller 130 may be accomplished as follows. First, the data points comprising the drive waveform shape of interest are calculated and saved in a waveform data file using, for example, software with mathematical processing and file saving capabilities. A waveform data file is a sequential list of numerical values that defines the waveform shape. Commercially available applications software, such as Mathcad or Mathematica, can be used to create these waveform data files, or similar waveform composition software can be developed using a programming language. Mathematical formulae that may be used for calculating and/or providing some of the waveform shapes are illustrated in FIGS. 7-18.

Second, the waveform data files created above are stored in the controller 130 (for example, in a memory such as the library 132).

Third, following selection of a specific stored waveform (by choice 134 or selection 136/138), the actual waveform pulse is created by sequentially reading the data points $y_i$ that comprise the selected waveform through a D/A converter in the waveform generator 118 at either a fixed or an adjustable sampling frequency $f_s$ that provides a waveform pulse of time duration $t_N$ according to $N=t_N \cdot f_s$, where N+1 is the number of elements in the data file comprising the waveform shape. Timing of the $i^{th}$ data element $y_i$ is determined by the sampling frequency $f_s$ according to $t_i=i/f_s$.

Fourth, when the controller 130 receives a trigger signal 140 to eject a drop, the waveform pulse is generated by the waveform generator 118 using the D/A converter and then amplified to the desire pulse height (voltage) through use of the variable gain wideband amplifier of the piezo driver 116. The resulting control (drive) signal 114 actuates the transducer (or actuation means) of the fluid dispenser 112.

In general, the ejected drop volume and drop velocity are controlled by selection or adjustment of the waveform pulse height/amplitude (voltage) and/or pulse duration (time), and the range of achievable drop volumes and velocities is related to the selected or adjusted waveform shape. Control of pulse height/amplitude and pulse duration can be achieved by changing the amplifier gain and the sampling frequency, respectively. These adjustments effectively stretch or compress and magnify or de-magnify the waveform shapes that are being generated by the waveform controller 130. D.C. offset adjustments can also be made to the waveform.

The library 132 of the controller 130 can be pre-loaded with a plurality of different waveform shapes. If this controller 130 is equipped with a communications interface (for example, USB, RS-232, parallel, GPIB) it is also possible to update the library 132 of waveform shapes in the controller 130 from an external source (such as a computer), which may be connected to other computers via a network (for example, LAN, WAN, Internet), for the purpose of providing product upgrades or field support to installed products.

One embodiment can employ an electronic waveform controller 130 having an electronic interface and electronic memory such that specific waveforms can be downloaded to the controller from a personal computer or computer network and saved in the controller's memory (library) 132. This capability enables the waveform controller 130 to be upgraded either locally or remotely with waveforms that resolve particular application problems or with new drive waveforms as they become available.

Many piezoelectric actuated ink jet or dispensing devices (that is, dispensers 112) can be operated in two distinctly different operating modes. The first operating mode "fill before fire" refers to choosing the polarity of the drive waveform and the poling of the piezoelectric transducer such that the volume of a fluid chamber in proximity to the ejection orifice is initially expanded to cause fluid flow into the chamber and then is subsequently restored or compressed to eject a drop through the orifice. The reverse process occurs in the second operating mode "fire before fill" in which the volume of the fluid chamber is first reduced to cause drop ejection and then is subsequently restored or expanded in order to refill the fluid chamber.

The curvilinear drive waveforms used in accordance with embodiments of the present teachings can be used with either "fill before fire" or "fire before fill" operating modes, however the polarity of the drive waveform must be selected in accordance with which of these operating modes is utilized and with the poling of the piezoelectric transducer. While the drive waveforms illustrated in FIGS. 7-18 are shown with certain characteristic polarities, the present teachings also include the same drive waveforms having polarities opposite to those depicted in FIGS. 7-18 as well. Furthermore, an electronic waveform controller that can provide a number of distinctly different drive waveform shapes with both positive and negative polarities is useful for drop ejection from dispensers or print heads in either "fill before fire" or "fire before fill" operating modes.

It is further asserted that many distribution functions, in addition to those illustrated in FIGS. 7-18, can be used to calculate curvilinear waveform shapes for use in accordance with the present teachings. The following distribution functions and their inverses (that is, mirror images) and their inverted polarities can also be utilized to calculate curvilinear waveform shapes for use in a waveform controller 130 in accordance with the present teachings: Beta, Chi, Chi Squared, Fisher's z, Gamma, Fisher-Tippett (or Extreme Value or log-Weibull), Map-Airy, Normal Ratio, Student's t, Student's z, Uniform Sum, and Weibull. Again, positive or negative D.C. offsets may be added to waveforms generated from any of these distribution functions.

Furthermore, the present teachings are not limited to the foregoing examples, but include other curvilinear waveforms regardless of whether such other curvilinear waveforms may be defined mathematically. For example, the linear or exponential damping terms used to define the waveforms illustrated in FIGS. 7 and 8 could be replaced by a polynomial damping term or by a lookup table of indexed damping factors. In either of these examples, the essential waveform remains a damped sine wave, which may provide comparable drop ejection results when the damping factors are suitably chosen.

It is anticipated that all curvilinear waveforms having a positive or negative D.C. voltage offset with respect to 0 volts, which are otherwise the same as or similar to those defined and illustrated in FIGS. 7-18 or to those additional curvilinear waveforms aforementioned above, will provide similar drop ejection results and therefore lie within the scope of the present teachings.

It is anticipated that one or more of the curvilinear waveforms disclosed herein, or the like, can be utilized to form complex drive waveforms that include a multiplicity of waveform segments or waveform pulses, including unipolar and/or bipolar segments, that can be used with the present teachings. The complex drive waveforms may include a combination of curvilinear, rectilinear and/or polygonal waveform shapes.

While the curvilinear waveforms and waveform controller 130 disclosed herein have been demonstrated to be useful for driving drop-on-demand dispensers and ink jet print heads, it is anticipated that these waveforms and waveform controller may also be useful for driving continuous jet devices in various applications, such as ink jet printing, cell sorting, spraying, coating, or other non-contact fluid dispensing applications.

As discussed above, waveforms utilized in the electronic controller 130 are not necessarily restricted to the aforementioned curvilinear shapes. Additional drive waveforms, such as rectilinear, polygonal, exponential, and other non-linear waveforms, can also be incorporated into the electronic controller 130 along with curvilinear waveforms in order to support stable drop ejection for broad ranges of fluid types and end user requirements.

Reference is now made to FIG. 19 where there is shown a block diagram of a system 100' for producing droplets of a fluid in accordance with one embodiment. The system 100' includes at least one piezoelectric drop-on-demand dispenser 112 which is actuated in response to an electrical control signal 114 (also referred to as a drive signal) generated by a curvilinear waveform controller 130'. The dispenser 112 may have one of several piezoelectric actuation configurations including, for example, a squeezer-type capillary tube piezo dispenser (a microdispenser) for use in dispensing a liquid containing chemically or biologically active substances (for example, in a microarraying application) or a piezoelectric ink jet printing head for use in dispensing a printing ink or specialty fluid.

The curvilinear waveform controller 130' includes a high voltage wideband amplifier 150 capable of driving capacitive loads with a reasonably fast slew rate and generating voltage signals with levels up to at least about ±150 volts with very little resistive loading. The amplifier 150 outputs the control (drive) signal 114 in response to an input signal 120 output from a digital-to-analog converter 152 that can have, for example, at least an 8 bit resolution and at least a 1 μsec sampling rate. The digital-to-analog converter 152 receives a digital signal 154 that is representative of a certain curvilinear drive waveform which has been selected 160 from a waveform library 132. More specifically, the waveform library 132 stores data in the form of waveform data files which include sequential lists of numerical values that define the waveform shapes. By reading this data out of a waveform data file and applying it to the digital-to-analog converter 152, an analog representation of the waveform (signal 120) is generated for subsequent amplification and then application to the piezo dispenser 112.

The sampling frequency $f_s$ at which the waveform data is read out of the library 132 can be adjusted in order to effectuate control over the duration of the curvilinear drive waveform pulse which is applied to the piezo dispenser 112. This adjustment over sampling frequency is effectuated by a waveform shape adjuster 156 so as to produce the curvilinear waveform with a desired shape. It should be noted that control over pulse height can be effectuated through gain adjustment in the amplifier 150. The adjustments or selections with respect to sampling frequency and gain effectively stretch or compress and magnify or de-magnify the selected curvilinear waveform shape being generated by the controller 130'. These waveform shape-affecting parameters, as well as other parameters, may be selected by the user (see, reference 134 in FIG. 6) or automatically selected (see, references 136 and 138 in FIG. 6).

The data defining the curvilinear waveforms may be supplied by a personal computer 124 (or other network or data connection) which is interfaced to the library 132. The illustrated library 132 stores waveform data for many curvilinear shapes (including those discussed above) and also can include waveform data for rectilinear or polygonal shapes (such as those shown in FIGS. 2-5).

The selection 160 of a certain one of the waveforms from the library 132 can be either a user choice (see, reference 134 in FIG. 6) of a desired waveform shape from a menu of options or an automated selection (see, references 136 and 138 in FIG. 6) of an identified waveform shape from the library in view of certain user specified criteria. The waveform shape adjuster 156 may comprise a microprocessor having access to ROM/RAM that is programmed to respond to the trigger 140 signal for initiating pulse generation and further respond to the select waveform 160 signal to choose the selected waveform from the library 132. Additionally, the microprocessor may be programmed with instructions (waveform selection functionality 136) for making the waveform selection in view of user specifications (reference 138). Control over waveform shape parameters (such as, for example, amplitude and/or pulse width) is further executed by the adjuster 156. These shape-related parameters are adjustable in either an incremental or continuous manner so as to achieve the desired drop ejection characteristic (for example, the stable ejection of uniform fluid drops of a given fluid in a certain fluid dispensing or ink jet printing application).

Although some embodiments of the disclosed method and apparatus have been illustrated in the accompanying Drawings and described in the foregoing Detailed Description, it will be understood that the disclosed methods and apparatus are not limited to the embodiments disclosed, but are capable of numerous rearrangements, modifications and substitutions without departing from the spirit of the disclosed methods and apparatus as set forth and defined by the following claims.

What is claimed is:

1. An apparatus comprising:

a waveform generator that is configurable to generate a selected one of a plurality of curvilinear waveform shapes;

a driver that generates a pulsed drive signal having the selected curvilinear waveform shape;

a processor executing processor instructions using a decision tree to identify the selected curvilinear waveform shape based on selection specifications; and a dispenser that responds to the pulsed drive signal to eject fluid.

2. The apparatus of claim 1 wherein the dispenser is a piezoelectrically actuated dispenser.

3. The apparatus of claim 2 wherein the piezoelectrically actuated dispenser is a Piezo Tip.

4. The apparatus of claim 2 wherein the piezoelectrically actuated dispenser is an ink jet dispenser.

5. The apparatus of claim 2 wherein the piezoelectrically actuated dispenser is a drop-on-demand dispenser.

6. The apparatus of claim 1 wherein the dispenser is a piezoelectrically actuated continuous jet device.

7. The apparatus of claim 1 wherein the driver comprises a variable gain amplifier.

8. The apparatus of claim 1 wherein the selection specifications include drop volume.

9. The apparatus of claim 1 wherein the plurality of curvilinear waveform shapes are stored in a waveform shape library for selection to configure the waveform generator.

10. The apparatus of claim 1 wherein the processor is operable to select the curvilinear waveform shape and configure the waveform generator.

11. The apparatus of claim 1 wherein the curvilinear waveform shape is associated with a Beta distribution.

12. The apparatus of claim 1 wherein the curvilinear waveform shape is a sinusoidal waveform.

13. The apparatus of claim 1 wherein the selected curvilinear waveform shape is damped.

14. The apparatus of claim 1 wherein the selected curvilinear waveform shape is rectified.

15. The apparatus of claim 1 wherein the waveform generator comprises:

a data store for storing digital representations of the plurality of curvilinear waveform shapes; and a digital-to-analog converter for converting the digital representation of the selected one of the curvilinear waveform shapes into an analog curvilinear waveform shape signal;

wherein the driver amplifies the analog curvilinear waveform shape signal to generate the drive signal.

16. The apparatus of claim 15 wherein the waveform generator further comprises a waveform shape adjuster that controls a pulse duration and waveform shape parameters of the curvilinear waveform shape signal.

17. The apparatus of claim 16 wherein the waveform shape adjuster further controls driver setting of an amplitude of the drive signal.

18. The apparatus of claim 1 wherein the drive signal has a first segment and a second segment.

19. The apparatus of claim 18 wherein the first and second segments have different curvilinear waveform shapes.

20. The apparatus of claim 1 wherein the curvilinear waveform shape is a Lorentzian waveform.

21. The apparatus of claim 1 wherein the curvilinear waveform shape is a Gaussian waveform.

22. The apparatus of claim 1 wherein the curvilinear waveform shape is a logistic waveform.

23. The apparatus of claim 1 wherein the curvilinear waveform shape is a lognormal waveform.

24. The apparatus of claim 1 wherein the curvilinear waveform shape is a Maxwell waveform.

25. The apparatus of claim 1 wherein the curvilinear waveform shape is a Rayleigh waveform.

26. The apparatus of claim 1 wherein the curvilinear waveform shape is associated with a Chi distribution.

27. The apparatus of claim 1 wherein the curvilinear waveform shape is associated with a Chi Squared distribution.

28. The apparatus of claim 1 wherein the curvilinear waveform shape is associated with a Fisher's z distribution.

29. The apparatus of claim 1 wherein the curvilinear waveform shape is associated with a Gamma distribution.

30. The apparatus of claim 1 wherein the curvilinear waveform shape is associated with a Fisher-Tippett distribution.

31. The apparatus of claim 1 wherein the curvilinear waveform shape is associated with a Map-Airy distribution.

32. The apparatus of claim 1 wherein the curvilinear waveform shape is associated with a Normal Ratio distribution.

33. The apparatus of claim 1 wherein the curvilinear waveform shape is associated with a Student's t distribution.

34. The apparatus of claim 1 wherein the curvilinear waveform shape is associated with a Student's z distribution.

35. The apparatus of claim 1 wherein the curvilinear waveform shape is associated with a Uniform Sum distribution.

36. The apparatus of claim 1 wherein the curvilinear waveform shape is associated with a Weibull distribution.

37. The apparatus of claim 1 wherein the selection specifications include drop velocity.

38. The apparatus of claim 1 wherein the selection specifications include amplitude.

39. The apparatus of claim 1 wherein the selection specifications include pulse width.

40. The apparatus of claim 1 wherein the selection specifications include dispenser type.

41. The apparatus of claim 1 wherein the selection specifications include fluid type.

* * * * *